US005884502A

United States Patent [19]

Jones et al.

[11] Patent Number: 5,884,502

[45] Date of Patent: Mar. 23, 1999

[54] APPARATUS AND METHOD FOR LOADING ICE INTO A STORAGE BIN

[75] Inventors: Brian Carter Jones, Collinsville; Richard Norman Chasse, Morris, both of Conn.; Jeffrey Alan Rutchik, North Easton, Mass.; Robert Allen Crosby, Jr., Marshfield, Mass.; David George Kmetz, Douglas, Mass.

[73] Assignee: IMI Wilshire Inc., Anoka, Minn.

[21] Appl. No.: 924,606

[22] Filed: Sep. 25, 1997

[51] Int. Cl.[6] ..... F25C 5/18

[52] U.S. Cl. ..... 62/344; 141/331; 141/332; 141/340; 141/338; 141/383; 220/212

[58] Field of Search ..... 62/344; 193/2 R, 193/3, 15, 17; 232/43.1, 43.5; 220/212, 908.3; 141/331, 332, 340–342, 338, 375, 383, 386

[56] References Cited

U.S. PATENT DOCUMENTS

| | | | |
|---|---|---|---|
| 2,549,572 | 4/1951 | Campanelli | 220/212 |
| 2,586,588 | 2/1952 | Weseman et al. | 62/344 |
| 2,899,804 | 8/1959 | Carew | 62/344 |
| 5,147,056 | 9/1992 | Ma | 232/43.1 |
| 5,192,121 | 3/1993 | Stutler | 232/43.1 |
| 5,211,030 | 5/1993 | Jameson | 62/344 |
| 5,261,468 | 11/1993 | Scheel | 141/332 |
| 5,472,111 | 12/1995 | Renfrew | 220/212 |

*Primary Examiner*—William E. Tapolcai
*Attorney, Agent, or Firm*—Sten Erik Hakanson

[57] ABSTRACT

The present invention concerns a combination ice chute and ice bin covering door for directing ice into the ice storage area of an ice or beverage dispenser. The ice chute cover is pivotally secured to a top surface of the beverage dispenser so that it can move from a closed position to an ice directing/loading position. In the closed position the ice chute cover serves to cover an opening to the ice storage area of the dispenser. A handle on the chute cover can be grasped to manually swing it between both positions. In the ice loading position a portion of the chute extends outward of the perimeter of the beverage dispenser. In operation, the handle is used to move the chute cover from the closed position to the loading position. A bucket of ice can then be lifted so that the open end thereof rests on the lip of the chute cover. The bucket can then be tipped upward so as to empty its ice contents onto the bottom surface of the chute cover. The ice then flows along the bottom surface and is directed thereby towards the back edge, where it then falls into the ice retaining area of the dispenser.

6 Claims, 15 Drawing Sheets

1
9
11a
9b
9a
10
8
11b
5

1
12
12
11
11b
15
15
5
11a
13a
14
13a
8

1
12
4
1
3
4a
8
5

22
20
20
19
1
24
24
23
12
11c
11
11c
16
11a
21
14
11b
17a
17a
5
17a
4

23
24
11a
25
11c 78
76
60
84
70
64
50
68
66
46
80
40
44
48

APPARATUS AND METHOD FOR LOADING ICE INTO A STORAGE BIN

This application claims benefit of provisional application Ser. No. 60/025,942 filed Sep. 11, 1996, and this application claims benefit of provisional application Ser. No. 60/025,943 filed Sep. 11, 1996.

1. Field of the Invention

The present invention is directed to an improved structure and method for loading ice into a storage bin, and more particularly, to an improved ice chute and ice bin cover structure and a method for using this structure to load ice into a beverage dispenser ice bin.

2. Background

Carbonated beverage dispensers for mixing a quantity of carbonated water with a quantity of flavored syrup and dispensing this mixture, are well known. Because it is desirable to dispense a beverage that is cooler than room temperature, many of these dispensers include bins for storing ice. This ice may be dispensed into cups before a beverage is dispensed, and/or may be used to chill the syrup and soda before it reaches the dispensing nozzle. In either case, whether due to melting or customer usage, the ice in the dispenser must be periodically replenished.

Beverage dispensers may be free-standing, or mounted on a counter top or ice chest. In either case, it is desirable to have the dispensing nozzles and actuators approximately 4 feet above the ground so that they are readily accessible to users. Furthermore, ice is generally stored at or above the level of the dispensing nozzles so that it can be dispensed by gravity. That level may be relatively high due to the design of the dispenser, which height can be in excess of five feet.

Typically, ice is reloaded into the storage bin of the dispenser by removing a lid portion or similar cover from the top thereof. A bag or bucket of ice must be carried to the dispenser and then lifted over the person's head and aligned with the opening, and then emptied into the bin. Since the exact location of the opening can not be seen directly by all but the tallest persons, most individuals need to use a step stool or ladder to reach the opening. It is preferred that the opening be seen, as a miscalculation as to the precise position of the opening can result in spilled ice. However, it is inconvenient to use a stool or ladder which must either be stored near the dispenser or carried to the dispenser. Even if the opening can be well targeted, several small buckets of ice may be required to fill the ice bin rather than one large bucket if the person filling the dispenser cannot easily lift the weight of a full ice bucket over their head.

This difficulty in lifting ice buckets and filling a dispenser may occasionally lead to spillage. Ice on the floor, whether on the customer or server side of the counter, is dangerous and can lead to accidents and liability problems. In addition, if a stool or ladder is used, it may interfere with access to the dispenser. Especially during high use periods, the process of refilling an ice bin can significantly interfere with the ability to dispense beverages quickly and safely. It would therefore be desirable to provide an ice dispenser and bucket that are easy to use by employees of all sizes, without the need for a step ladder, and that also allows for the quick and safe refilling of beverage dispenser ice bins.

SUMMARY OF THE INVENTION

The present invention concerns a combination ice chute and ice bin covering door for directing ice into the ice storage area of a beverage dispenser. The ice chute cover is pivotally secured to a top surface of the beverage dispenser so that it can move from a closed position to an ice directing/loading position. In the closed position the chute cover serves to cover an opening to the ice storage area of the dispenser. A handle on the chute cover can be grasped to manually swing it between both positions. In the ice loading position, a portion of the chute extends outward of the perimeter of the beverage dispenser. Viewed in this position, the chute cover includes a substantially flat ice flow surface having a lip edge extending outward of the dispenser top perimeter and a back edge positioned adjacent the ice bin opening. A pair of ice directing walls extend vertically from the bottom surface along opposite sides thereof between the front lip and back edge. A stop surface serves to contact the top of the dispenser when the chute cover is in the open position for retaining the chute cover in a particular open orientation.

In operation, the handle is used to move the chute cover from the closed position to the loading position. A bucket of ice can then lifted so that the open end thereof rests on the lip of the chute cover. The bucket is then be tipped upward so as to empty its ice contents onto the ice flow surface of the chute cover. The ice then flows along the that surface and is directed thereby, and by the vertical walls, towards the back edge, where it then falls into the ice retaining area of the dispenser. It can be appreciated that having the lip of the chute cover extend outward of the dispenser eliminates any doubt as to the exact location of the optimum bucket pour point. Thus, a ladder or stool will be unnecessary for most individuals as they need not look down into the opening to be assured of correct bucket placement. Also, having the front lip extend out over the dispenser makes the loading process easier for the individual lifting the bucket because they do not have to lift it over the top of the dispenser and while preventing it from contacting any portion thereof. With prior art dispensers, due to the weight of the ice, operators let the bucket rest on the top of the dispenser during loading. This behavior can result in damage to the dispenser, especially to the relatively fragile merchandiser/graphics structure extending along the front top edge of many dispensers. The stop surface holds the chute cover herein rigidly in a desired open orientation so that the merchandiser or other delicate parts of the dispenser are not contacted thereby during loading. Thus, the stop surface also permits the operator to rest the bucket on the front lip of the chute cover without risk of such damage. As a consequence of not having to bear the entire weight of the ice bucket and its contents and not having to lift the bucket up and over the top of the dispenser, the operator does not need to exert as much effort and greatly reduces the chance of back strain of other injury. In addition, the chute sidewalls serve to eliminate any spillage of ice during the loading process. As a consequence of the foregoing, the ice loading process can proceed more quickly and with less spillage than is the case with current beverage dispensing equipment.

DESCRIPTION OF THE DRAWINGS

A better understanding of the structure and operation of the present invention, and of the further objects and advantages thereof can be had by reference to the following detailed description which refers to the following figures, wherein.

DETAILED DESCRIPTION OF THE PREFERRED EMBODIMENTS

Figure 1:
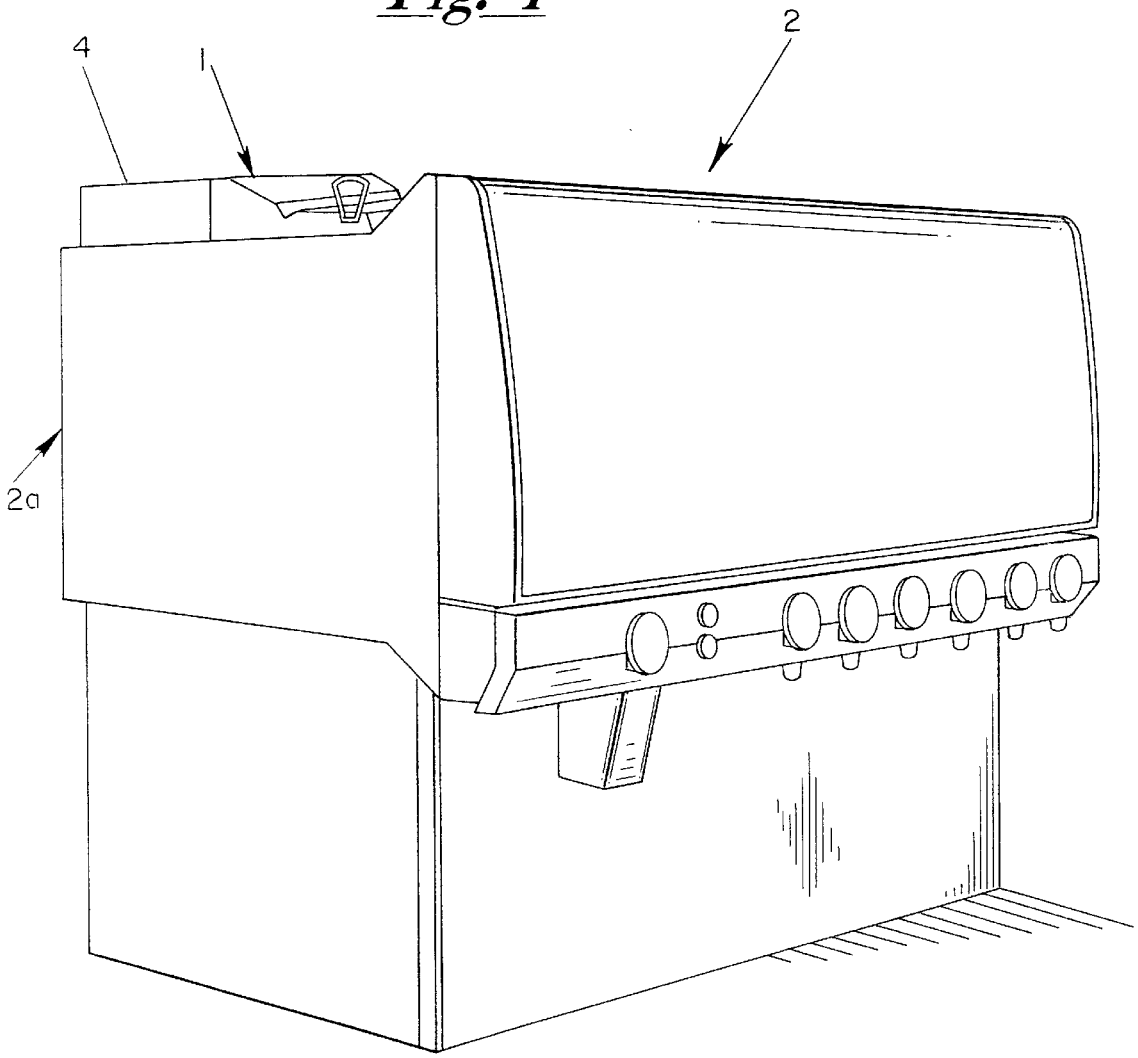
FIG. 1 shows a perspective view of a beverage dispenser.

A chute cover of the present invention is seen in FIGS. 1–4 and generally referred to by the numeral 1. A beverage dispenser 2 has a front end 3, a top end 4 and an internal ice retaining bin 5. Front end 3 includes a merchandiser cover 3*a* having a top portion 3*b* that extends above the level of top end 4. A partial rear ice bin cover 6 is secured to top end 4 over a portion of ice bin 5. Cover 6 includes a front perimeter edge 6*a* having a lower shoulder 6*b*. Chute cover 1 includes a rod 7 extending there through for cooperating with corresponding holes of brackets 8 extending from and secured to top end 4.

Figure 2:
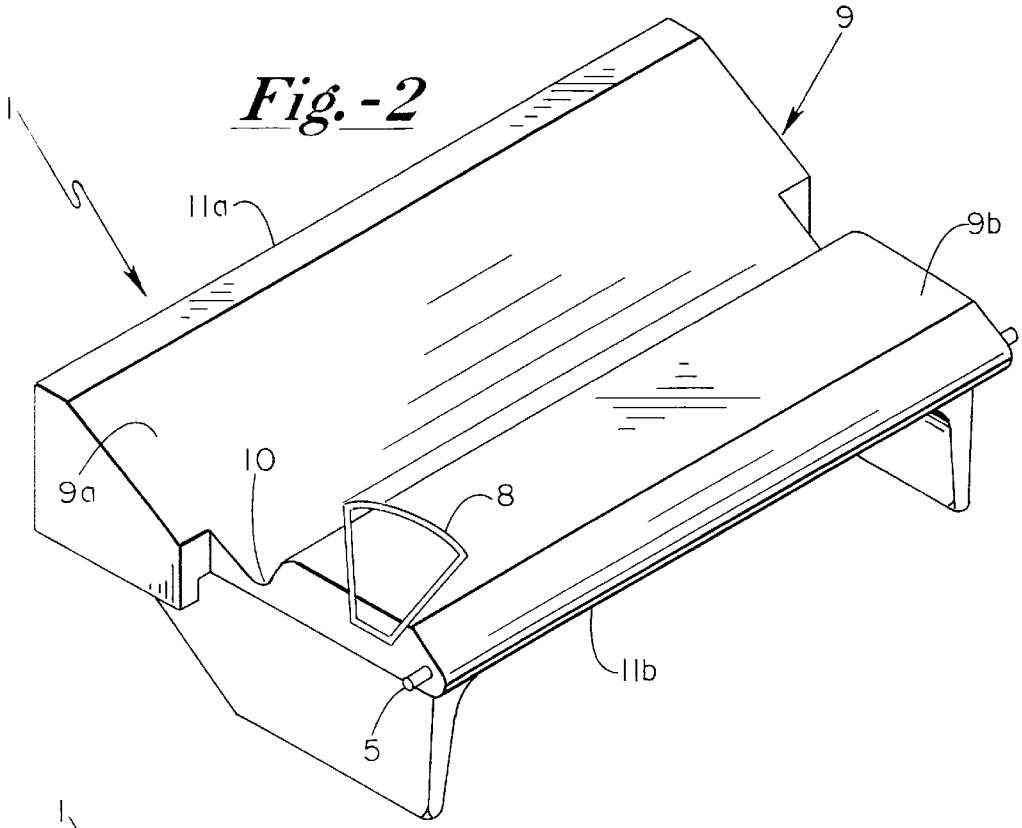
FIG. 2 shows a perspective top view of the chute cover of the present invention.
Figure 3:
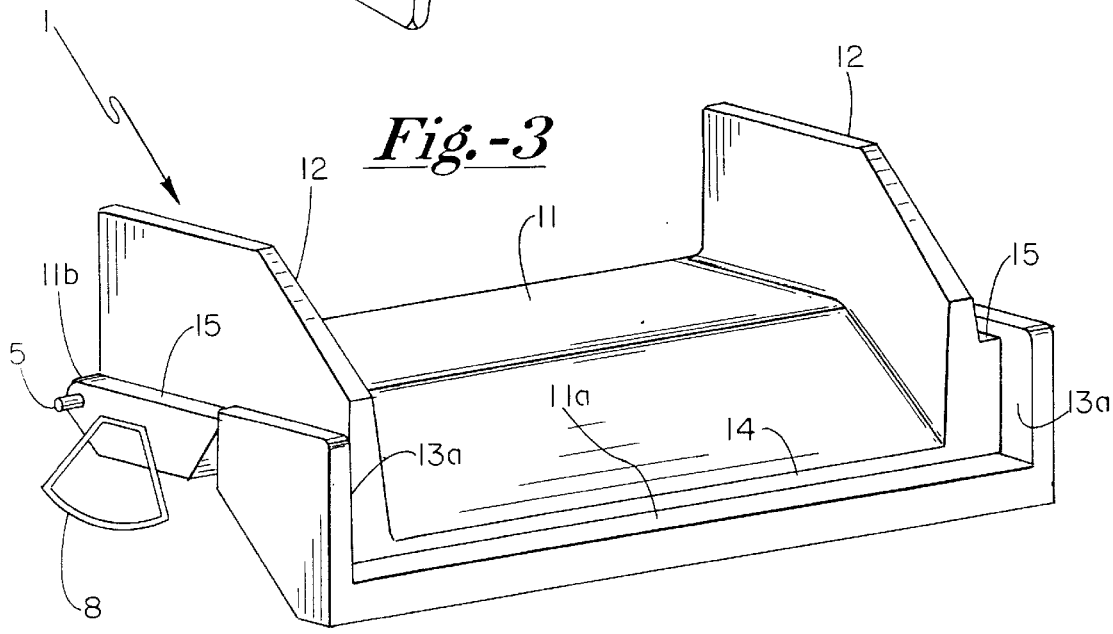
FIG. 3 shows a bottom perspective view of the chute cover of the present invention.
Figure 4:
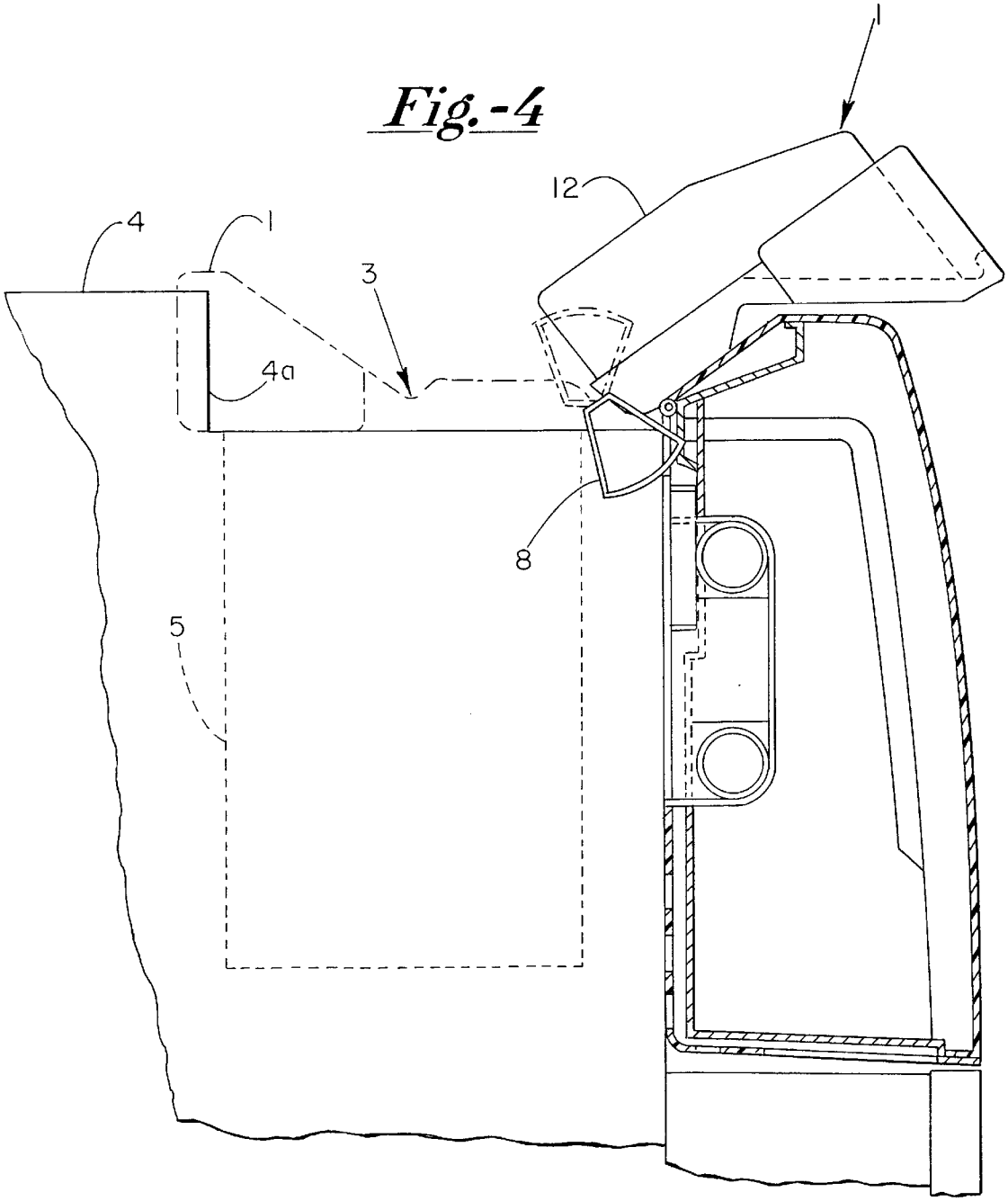
FIG. 4 shows a partial side plan cross-sectional view of the beverage dispenser of FIG. 1.

Chute cover 1 is operable by a handle H between a closed position, as seen in FIG. 1 and an open position as seen in FIG. 4. Referring also to FIGS. 2 and 3, chute cover 1 is seen to have a surface 9 having separate surface areas 9*a* and 9*b* separated by a groove 10, and also includes a stop surface 9*c*. An ice flow surface 11 extends opposite there from between a lip edge 11*a* and a back edge 11*b*. Ice flow guide walls 12 extend from surface 11 and ice bucket retaining recesses 11*c* extend into and along lip 11*a*. A rectangular U-shaped opening is defined by lip 11*a* and two shoulder areas 13*a*. A groove 14 runs along and adjacent lip 11*a*. Chute cover 1 also includes two shoulders 15 and a groove 16 running along back edge 11*b*. Two flanges 17*a* and a flange 17*b* extend upward from and around the perimeter of an ice bin opening 18.

Figure 5:
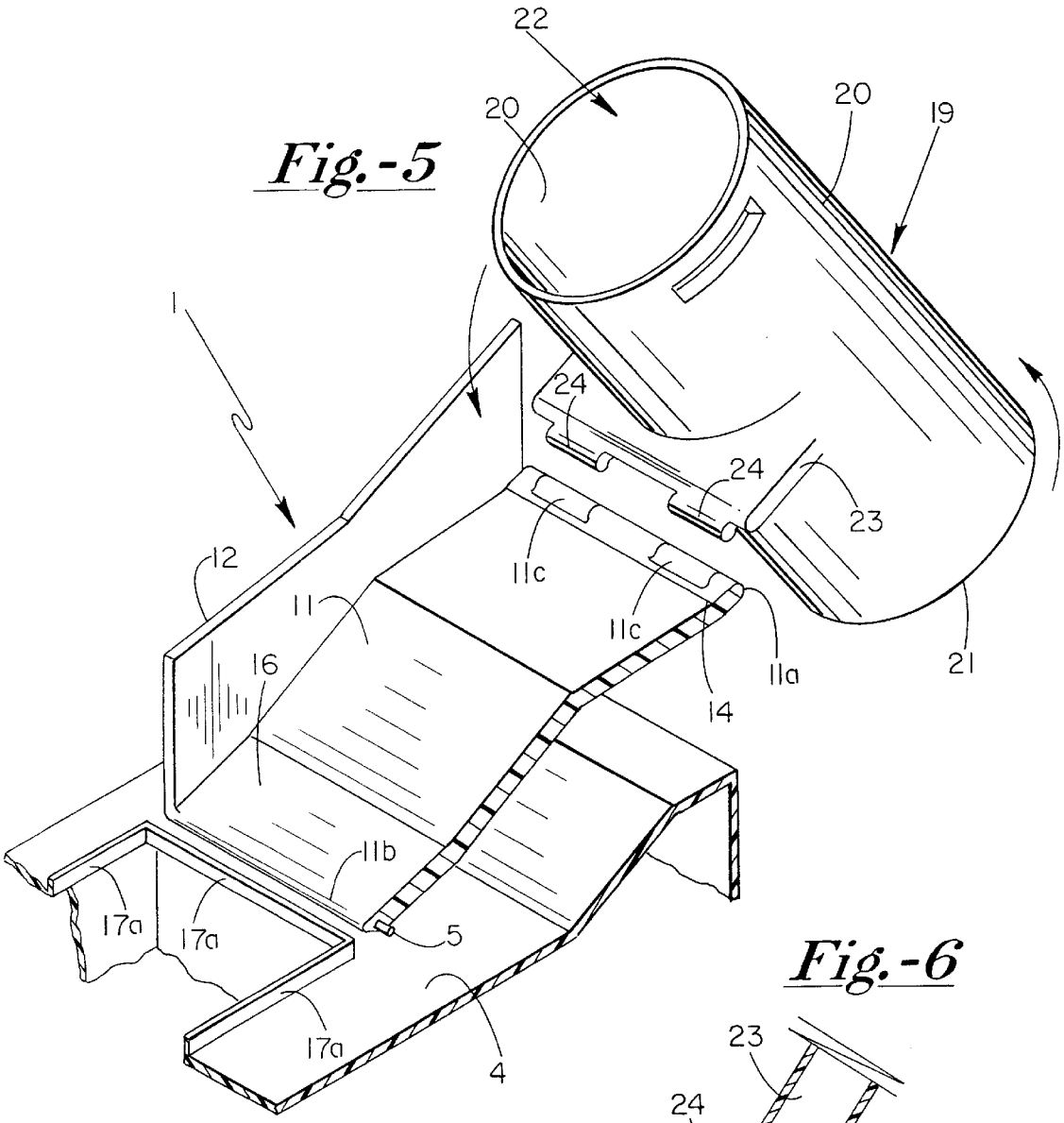
FIG. 5 shows a further top perspective view of the chute cover of the present invention.
Figure 6:
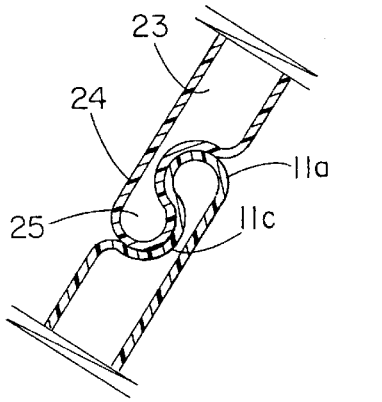
FIG. 6 shows and enlarged detail of the interaction of the ice bucket and chute cover of the present invention.

As seen by also referring to FIGS. 5 and 6 , a specially designed ice bucket 19 includes sidewalls 20 and a bottom 21 defining an interior 22 thereof. An integral bracket 23 includes a pair of arms 24 that extend therefrom and include protrusions 26.

Figure 7:
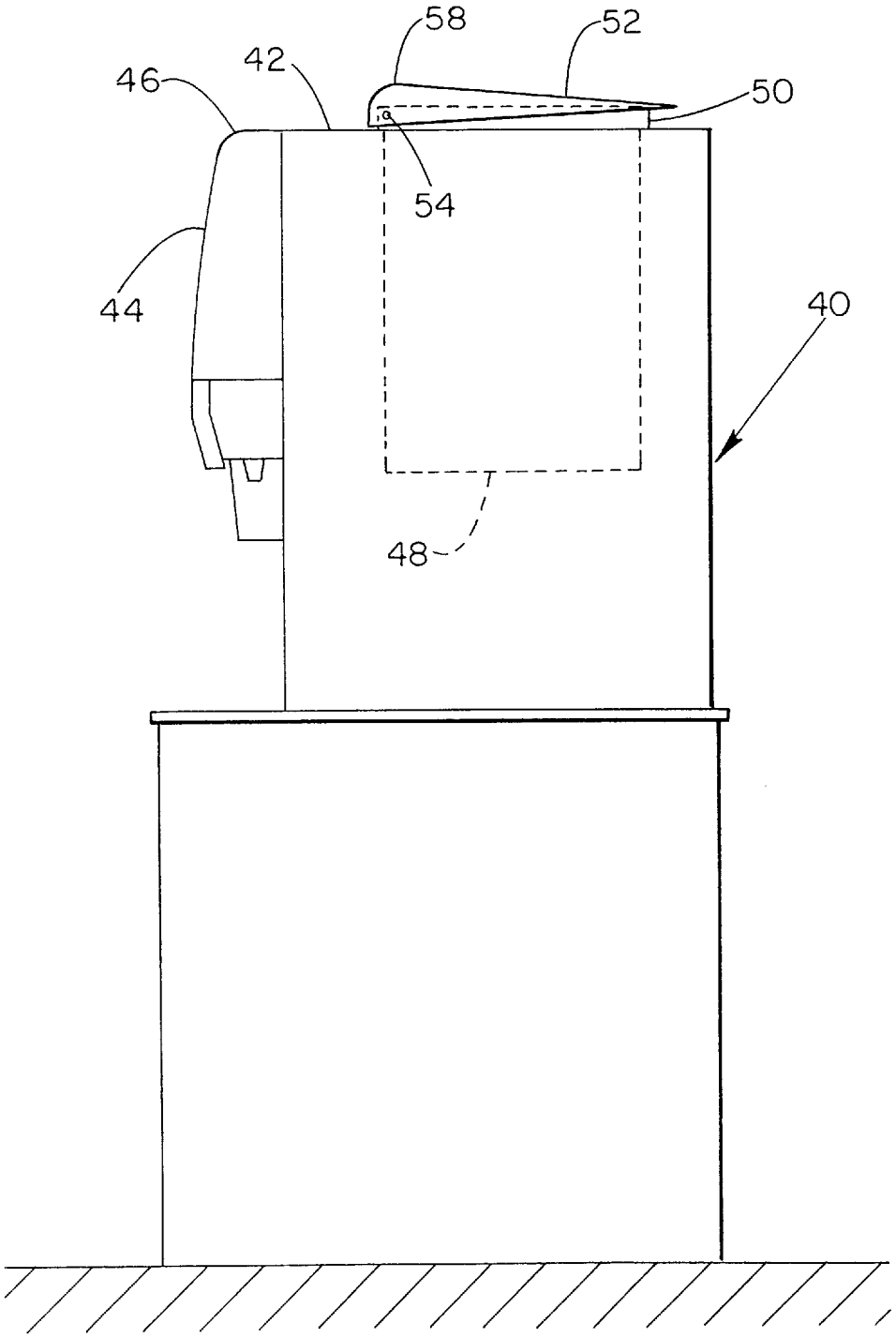
FIG. 7 shows side plan view of a second embodiment of the chute cover herein secured to a beverage dispenser.
Figure 8:
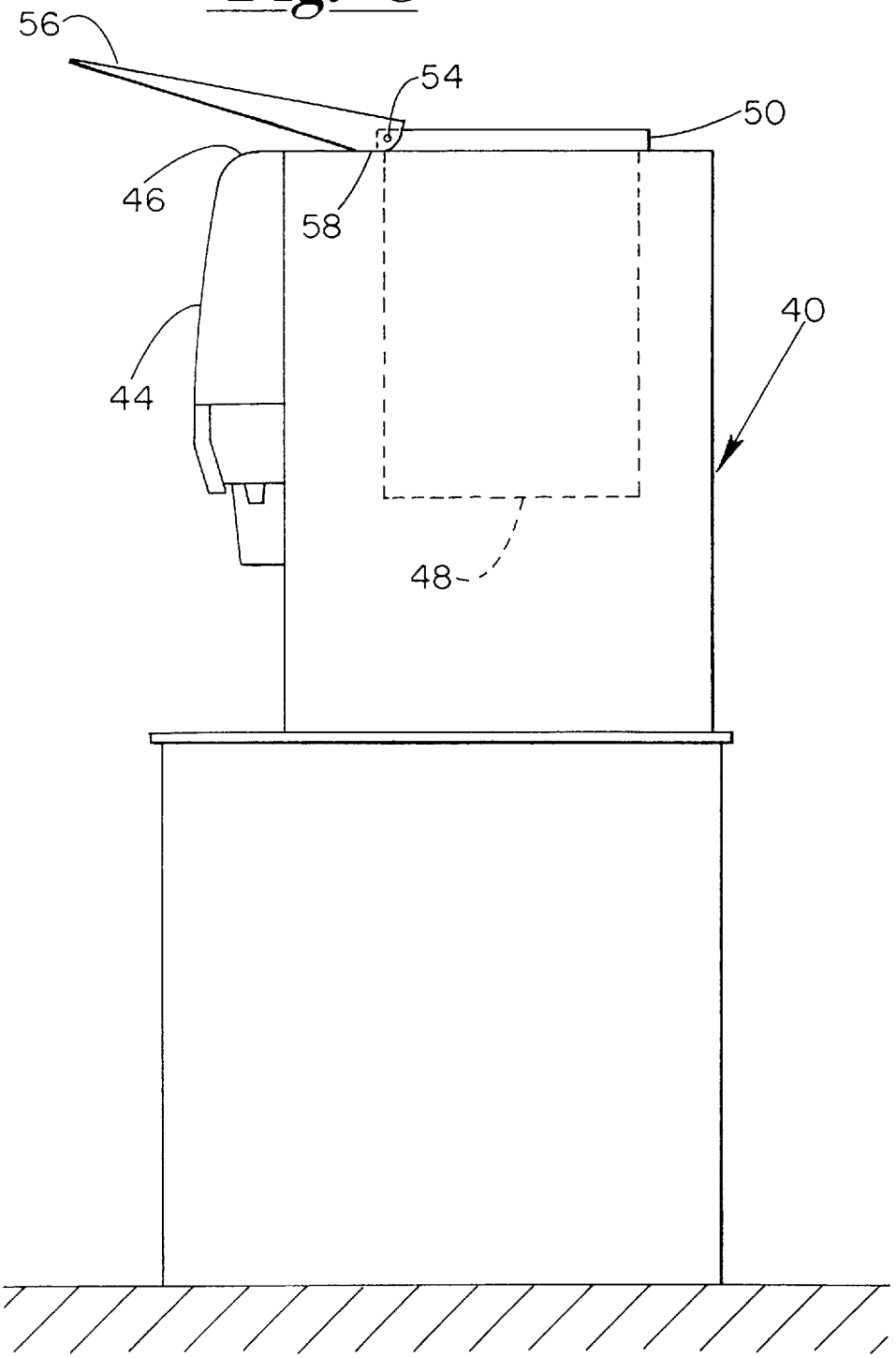
FIG. 8 shows a further side plan view of the embodiment of FIG. 7 in an open position.

In operation, chute cover 1 is moved to the open position by grasping handle H wherein lip 11*a* extends outward of the perimeter of dispenser front end 3 and outward of top surface 4. Chute cover 1 is held in its particular open position by contact between stop surface 9*c* and the surface of top end 4 wherein chute cover 1 is held thereby from moving beyond that point and contacting or resting on top portion 4*b* of merchandiser 4*a*. It can be understood, that chute cover surfaces 9*a* and 9*b* and groove 10 are angled and positioned to cooperate and fit with top portion 3*b* of merchandiser 3*a* so as to prevent any contact there between. This conformation allows chute cover 1 to rest in an open position wherein lip 11*a* is at a lower position with respect to ground level than would be the case without such formed fit. Bucket 19, containing ice in the interior 22 thereof, can then be lifted so that protrusions 26 fit into groove 14. Thus, bucket 19 is retained from easily slipping off of lip 11*a* and its weight is supported thereby. Bucket 19 can then be tipped lifting the bottom end 21 thereof upward so as to empty the ice contents thereof onto ice flow surface 11. It can then be appreciated that the general downward inclination of surface 11 will cause the ice to flow there along towards back edge 11*b* and then down into ice retaining bin area 5. Ice flow guide walls 12 can be seen to further direct the ice into bin 5 so that spillage thereof onto the floor surface is prevented. Those of skill will understand that a specialized bucket need not be used with chute cover 1 of the present invention. Any suitably sized bucket can be used wherein a top perimeter edged thereof is simply rested on lip 11*a*. When sufficient ice has been added to bin 5, chute cover 1 is closed to cover opening 18 wherein flange 17*b* cooperates to be retained in groove 16, shoulders 15 rest on flanges 17 and lip 11*a* rests on shoulder 6*b*. In this manner any particles or water are prevented from entering bin 5. FIGS. 7 and 8 show a second embodiment of the present invention. A dispenser 40 has a top 42 and a merchandiser 44 attached to the front of the dispenser with the merchandiser top 46 generally flush with top 42 of dispenser 40. The opening (not shown) into the ice bin 48 is surrounded by an upstanding lip 50 and includes a single chute cover 52 connected to the lip 50 by a hinge 54. Cover 52, as with chute cover 1, functions as an ice chute and includes recesses 56 that function in the same manner as groove 14 in the first embodiment. Because the top 46 of the merchandiser 44 is not raised with respect to the top 42 of the dispenser, ice chute 52 includes a stop surface 58 that contacts dispenser top 42 to keep the chute 52 angled with respect to top 42 when the chute is fully open. When chute 52 is in the fully open position shown in FIG. 8, it can be used with an ice bucket 19 as described with respect to the first embodiment.

Figure 9:
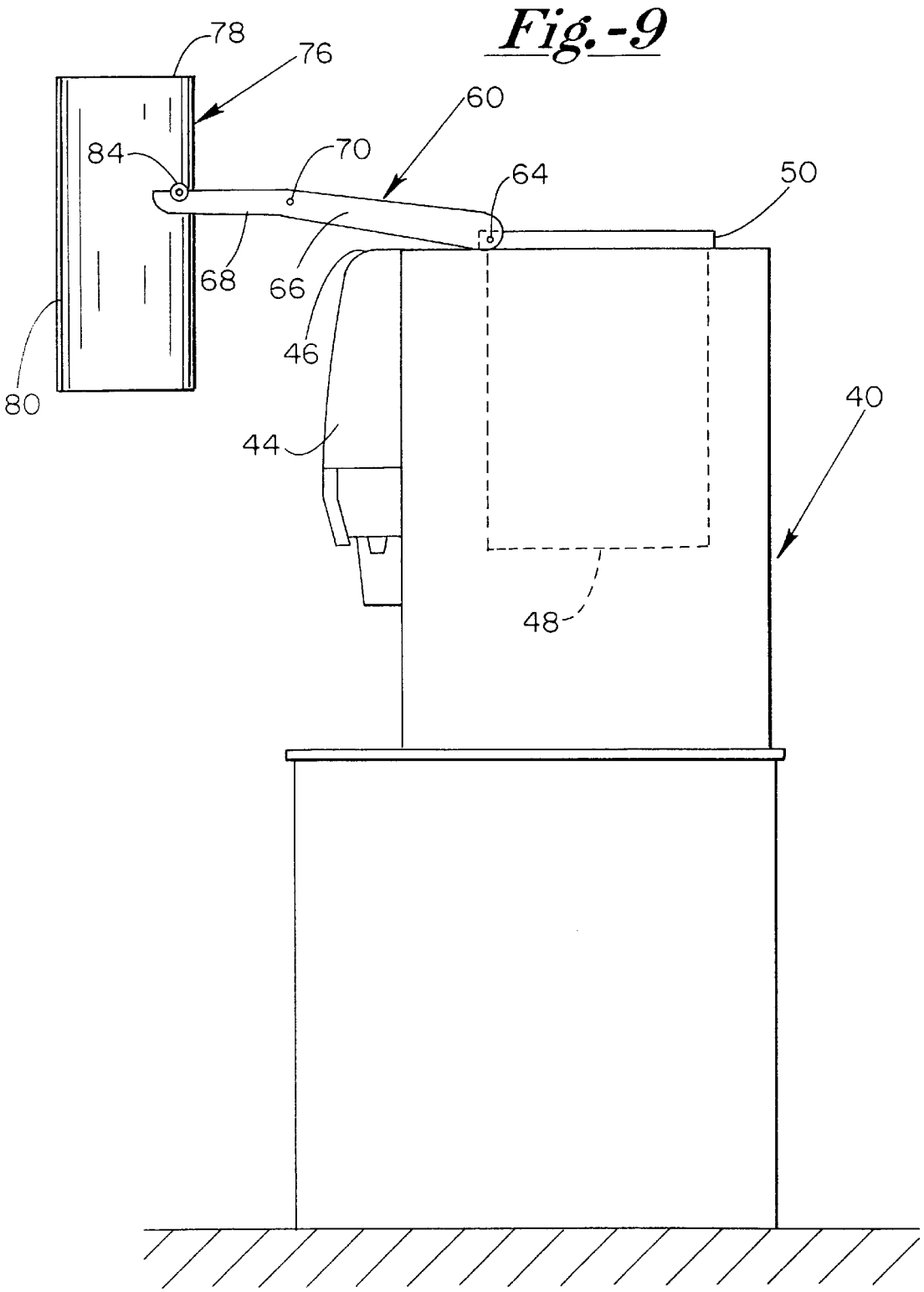
FIG. 9 shows a side plan view of a third embodiment of the chute cover herein secured to a beverage dispenser in an open position.
Figure 10:
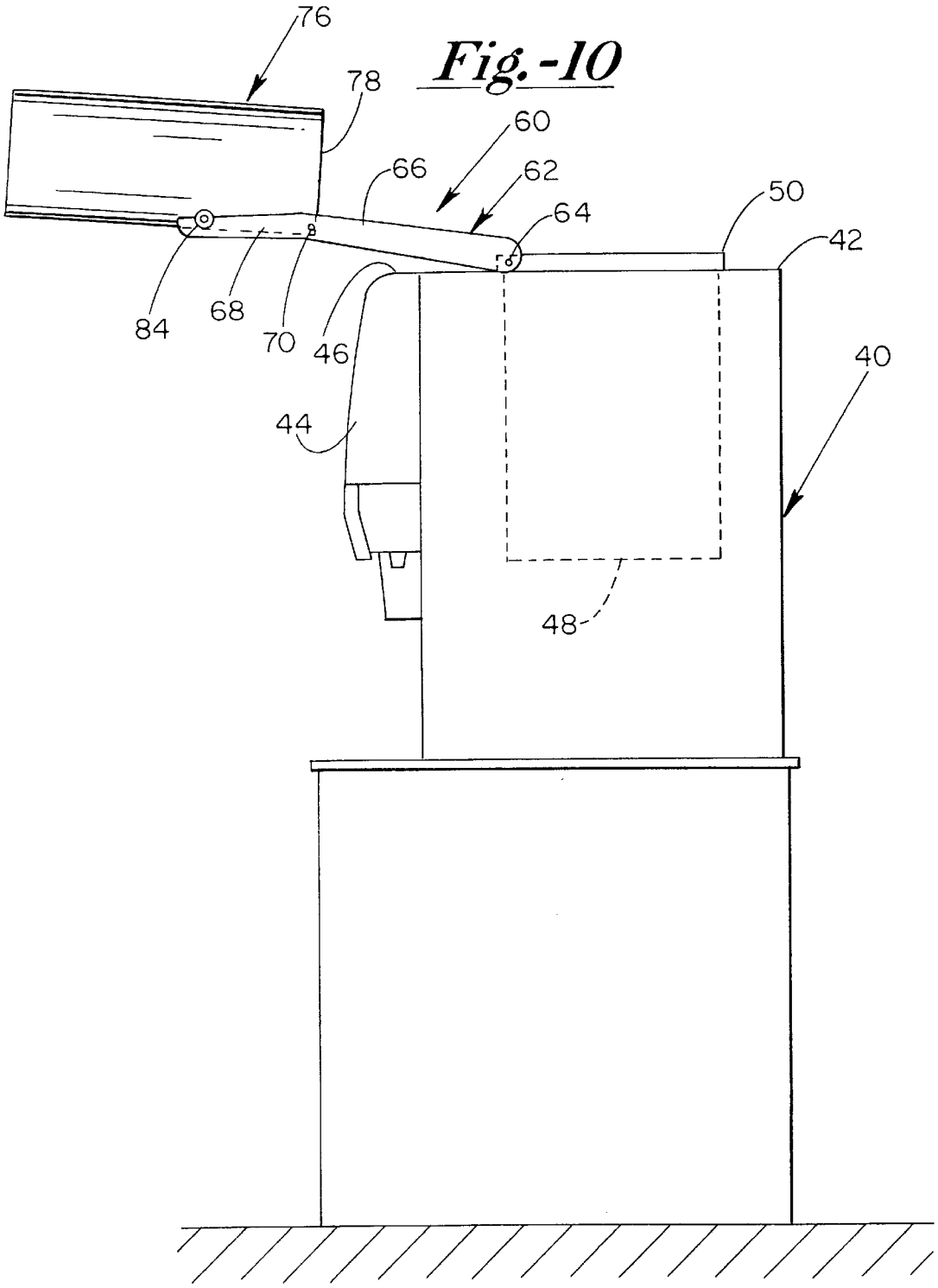
FIG. 10 shows a further side plan view of the third embodiment of the chute cover herein secured to a beverage dispenser in an open position.
Figure 11:
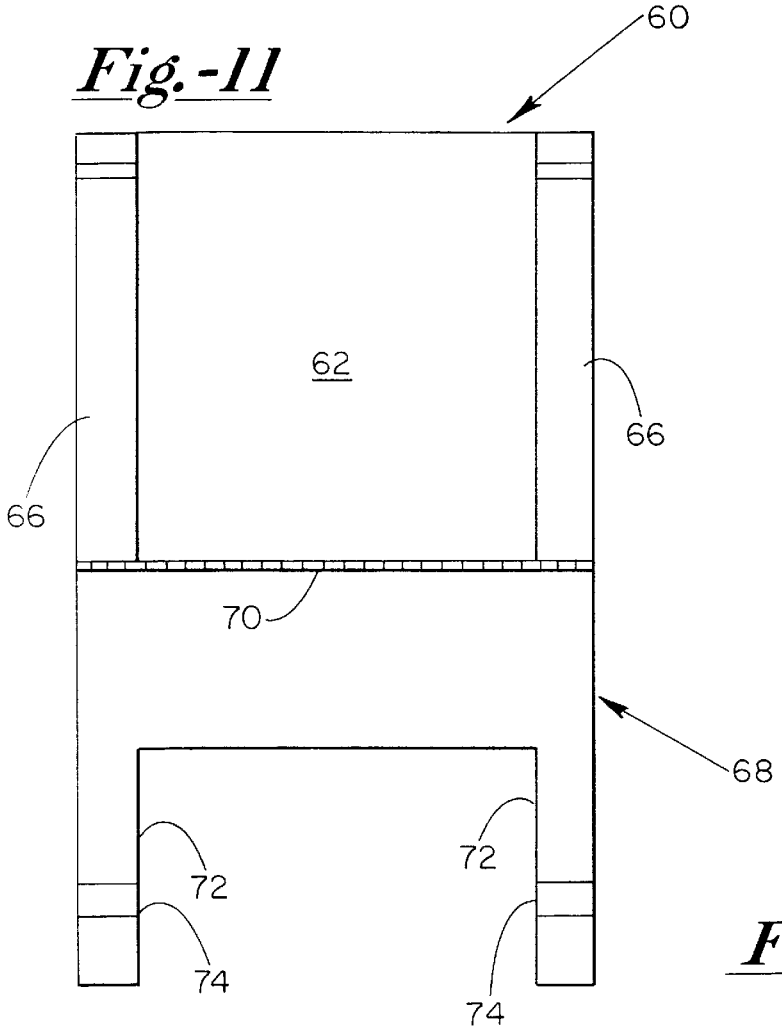
FIG. 11 shows a top plan view of the chute cover of FIGS. 9 and 10.
Figure 12:
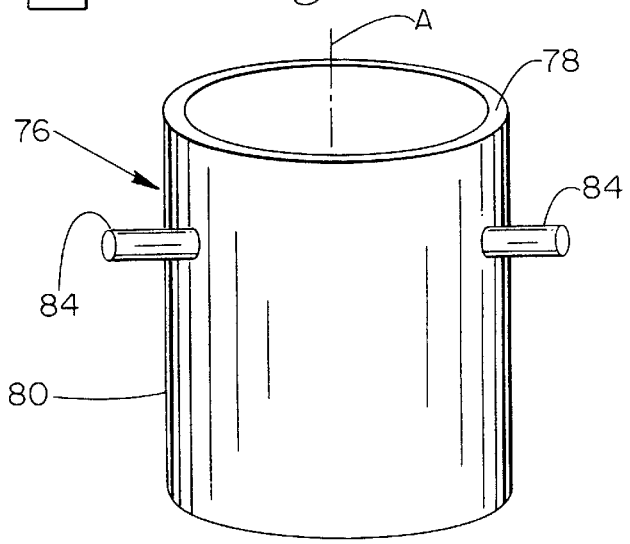
FIG. 12 shows a side plain view of a specialized bucket used with the third embodiment of the chute cover herein.
Figure 13:
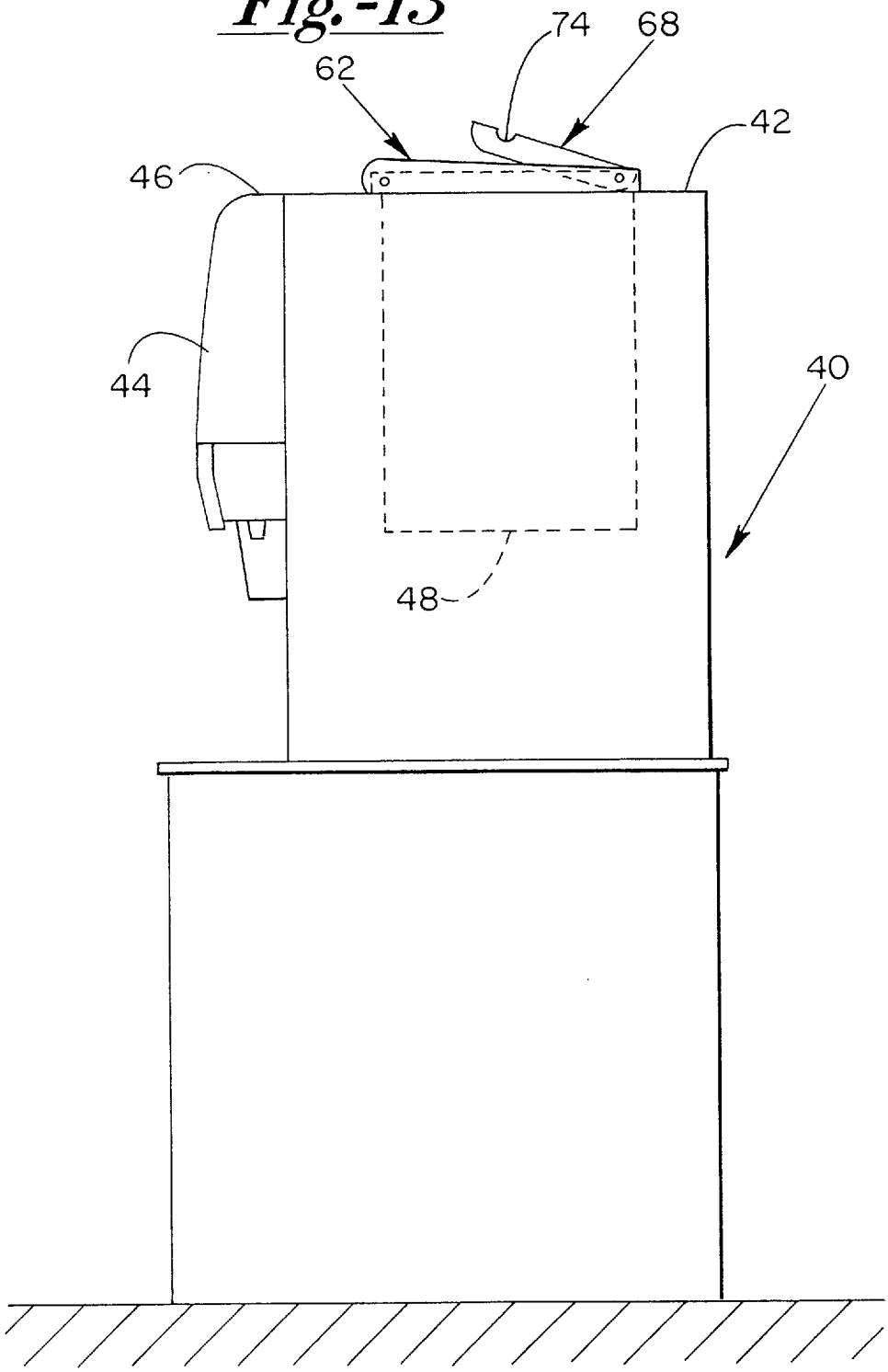
FIG. 13 shows a side plan view of the chute cover of FIGS. 9–11 in a closed position.

In a third embodiment of the present invention represented in FIGS. 9–13, a modified chute cover and bucket structure are used with the dispenser 40 shown in the second embodiment. Chute cover 60, a top plan view of which is shown in FIG. 11, includes an inner chute section 62 that is attached to upstanding lip 50 by a hinge 64 and which includes chute side walls 66. An outer chute section 68 is connected to the inner chute section at a second hinge 70. Outer chute 68 may be locked with respect to inner chute 62 so that the chutes are substantially co-planar and then released so that the chute sections can be folded for storage as shown in FIG. 13. The use of a locking hinge is well known and will not be described further herein. Outer chute section 68 further comprises a pair of parallel arms 72 extending away from section 68 on the side of section 68 opposite hinge 70. Each arm 72 includes a notch 74, the purpose of which will be described hereinafter.

The third chute cover embodiment shown in FIGS. 9–11 is used with a specially designed bucket 76, shown in FIG. 12. Bucket 76 includes a top perimeter edge 78, a side wall 80, a bottom wall 82. Bucket 76 also includes a pair of coaxial rods 84 extending from side wall 80 substantially tangential thereto and perpendicular to a central axis A. Rods 84 are positioned on surface 80 approximately one third of the distance there along down from top edge 78.

To load ice bin 48, chute 60 is opened and hinge 70 is locked to hold chute section 68 in a generally co-planar relationship to inner chute section 62 as shown in FIG. 9. In this configuration, outer chute section 70 extends over merchandiser 44 and away from ice bin 48. The bucket 76 is filled with ice and positioned between arms 72 of outer chute section 68 so that rods 84 enter notches 74. Notches 74 are rounded and allow bucket 76 to pivot about rods 84 therein. The ice chute supports the weight of bucket 76 and allows the person filling the ice bin to reposition his grip on the bucket. By holding the bucket at bottom wall 82 or side wall 80, bucket 76 can be pivoted about rods 84 so that top edge 78 moves toward ice chute 60 and into the position shown in FIG. 10 to dump the ice down chute 60 and into bin 48. After the bucket is removed, hinge 70 is unlocked, outer chute section 68 is folded against inner chute section 62, and the folded chute is closed over upstanding lip 50 to cover the ice bin 48 as shown in FIG. 13.

A fourth embodiment of the subject invention is shown in FIGS. 14–19. In this embodiment, a lift gate 90 is used to guide an ice bucket to a position above the dispenser and support the entire weight of the bucket as it is pivoted to dump a load of ice into a beverage dispenser ice bin.

Figure 14:
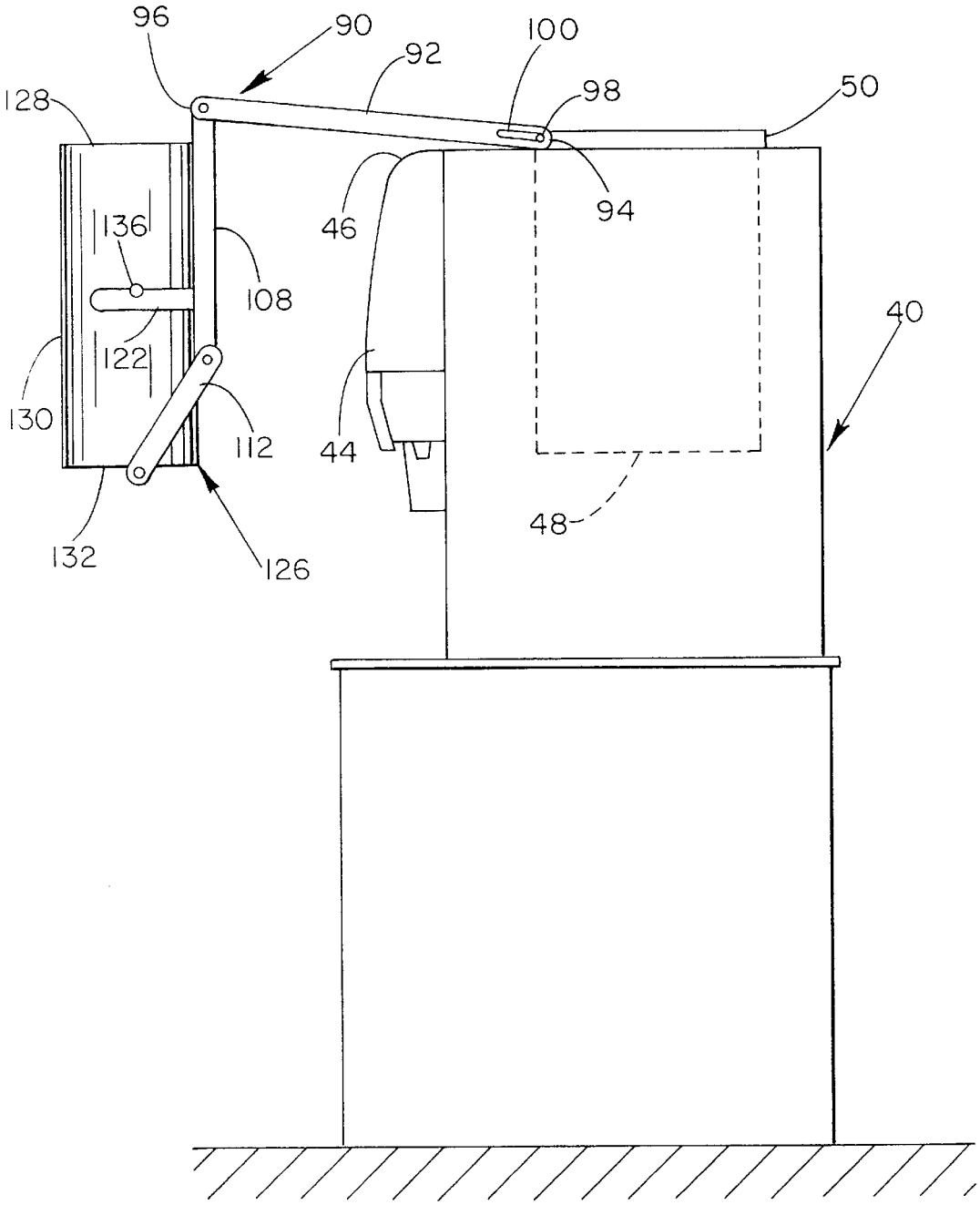
FIG. 14 shows a side plan view of a fourth embodiment of the chute cover herein secured to a beverage dispenser in an bucket receiving position.
Figure 16:
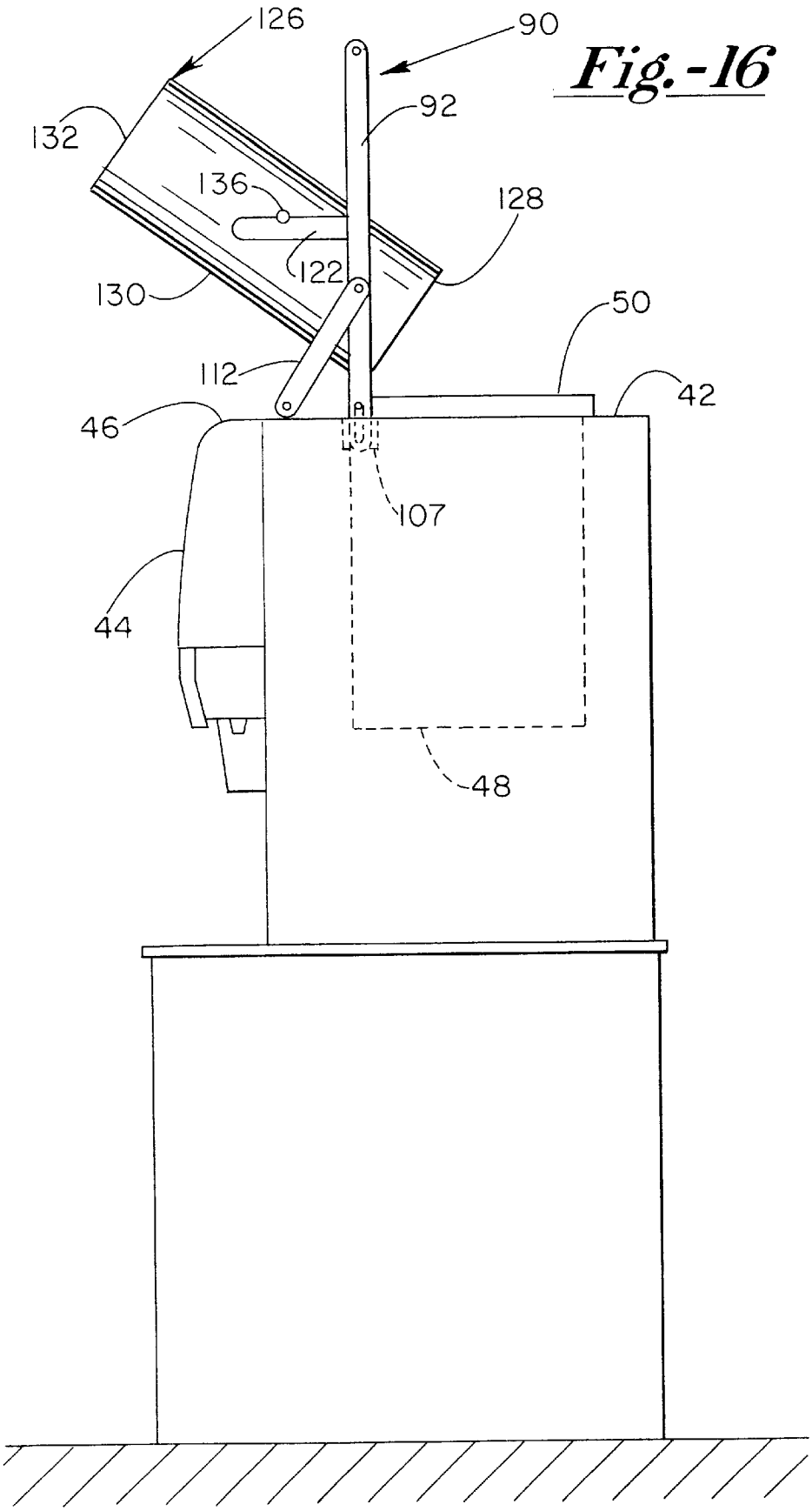
FIG. 16 shows a further side plan view of the fourth embodiment of the chute cover herein secured to a beverage dispenser in a bucket emptying position .
Figures 18, 19:
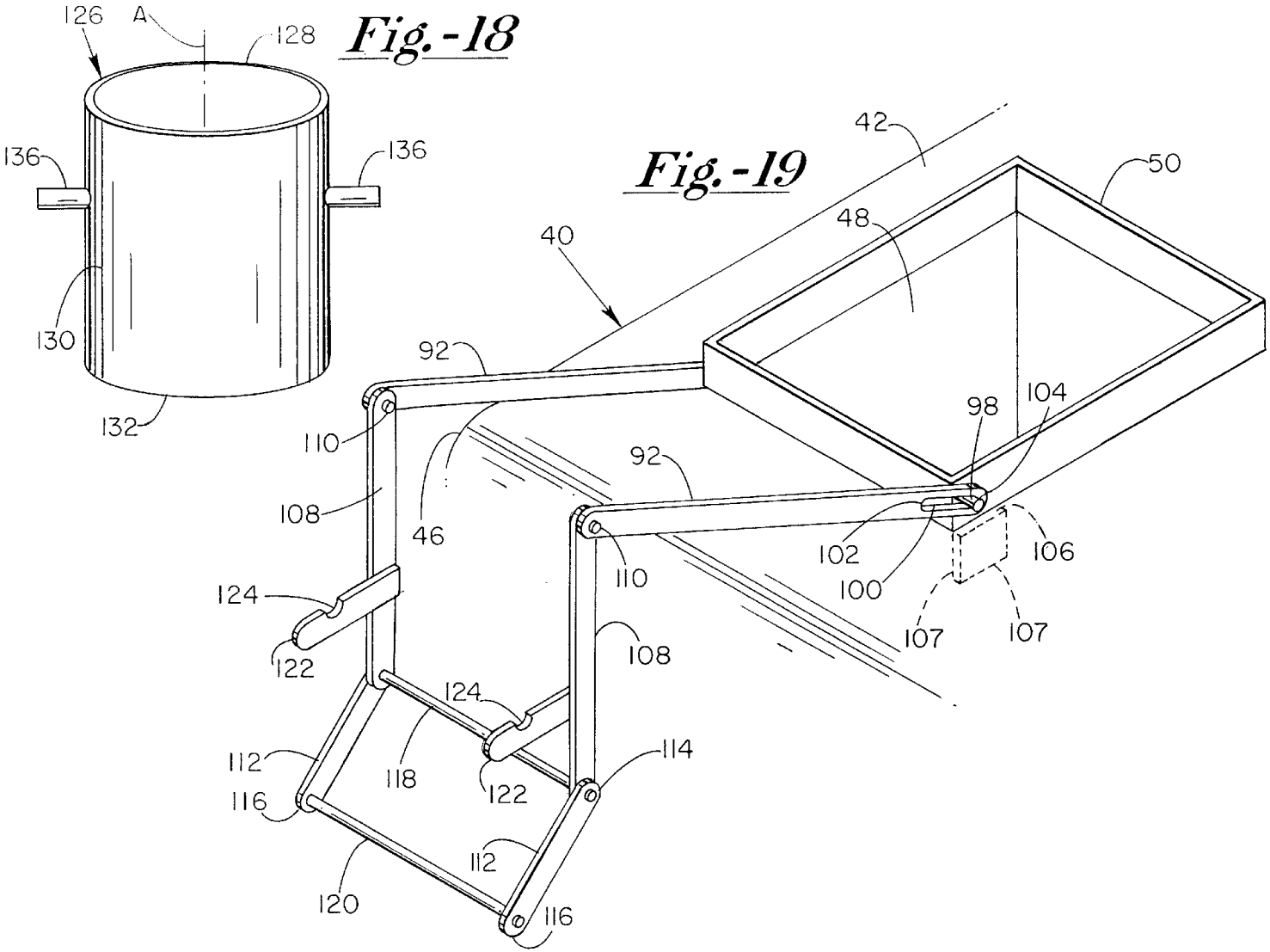
FIG. 18 shows a top plan view of the chute cover of FIGS. 14 and 17.
FIG. 19 shows a side plan view of a specialized bucket used with the fourth embodiment of the chute cover herein.

As seen in FIG. 14, lift gate 90 is attached to a beverage dispenser like the one shown in the previous embodiment and the same reference numerals to identify like parts. The lift gate assembly 90 includes two inner arm portions 92 (only one of which is visible in FIG. 14) having first ends 94 and second ends 96 connected to lip 50 by a rod 98. Inner arm portions 92 are approximately 24 inches long and extend away from lip 50, over merchandiser 44 and away from dispenser 40. First ends 94 of arms 92 each include an elongated opening 100 having a first end 102 and a second end 104. Rod 98 extends through opening 100 to support arms 92. A pair of slots 106 are located in top wall 42 of dispenser 40 below rods 98 as best seen in FIG. 19, and include sidewalls 107. A pair of middle arm portions 108 depend from inner arms 92 and are connected thereto by a hinge 110. Middle arm portions 108 are approximately 18 inches long. A pair of outer arm portions 112 having first ends 114 and second ends 116 and are fixedly connected to middle arms 108 at first ends 114 and extend away from the middle arms at about a 45 degree angle in the direction away from the upper arms 92. The first ends 114 are connected by a support rod 118 and the second ends 116 are connected by a support rod 120 as best seen in FIG. 16. Outer arm portions 112 are approximately 12 inches long. Finally, two 6 inch pivot arms 122 are connected to middle arm portions 108 about 6 inches from outer arms 112 and extend perpendicularly from middle arms 108. Pivot arms 122 include notches 124 to help hold a bucket in place as described hereinafter.

The lift gate 90 of this embodiment is used with an ice bucket 126 as shown in FIG. 18. Bucket 126 includes a top wall 128, a side wall 130, a bottom wall 132, an axis 134 and a pair of coaxial rods 136 extending from side wall 130 perpendicular to the axis central axis A thereof.

Figure 15:
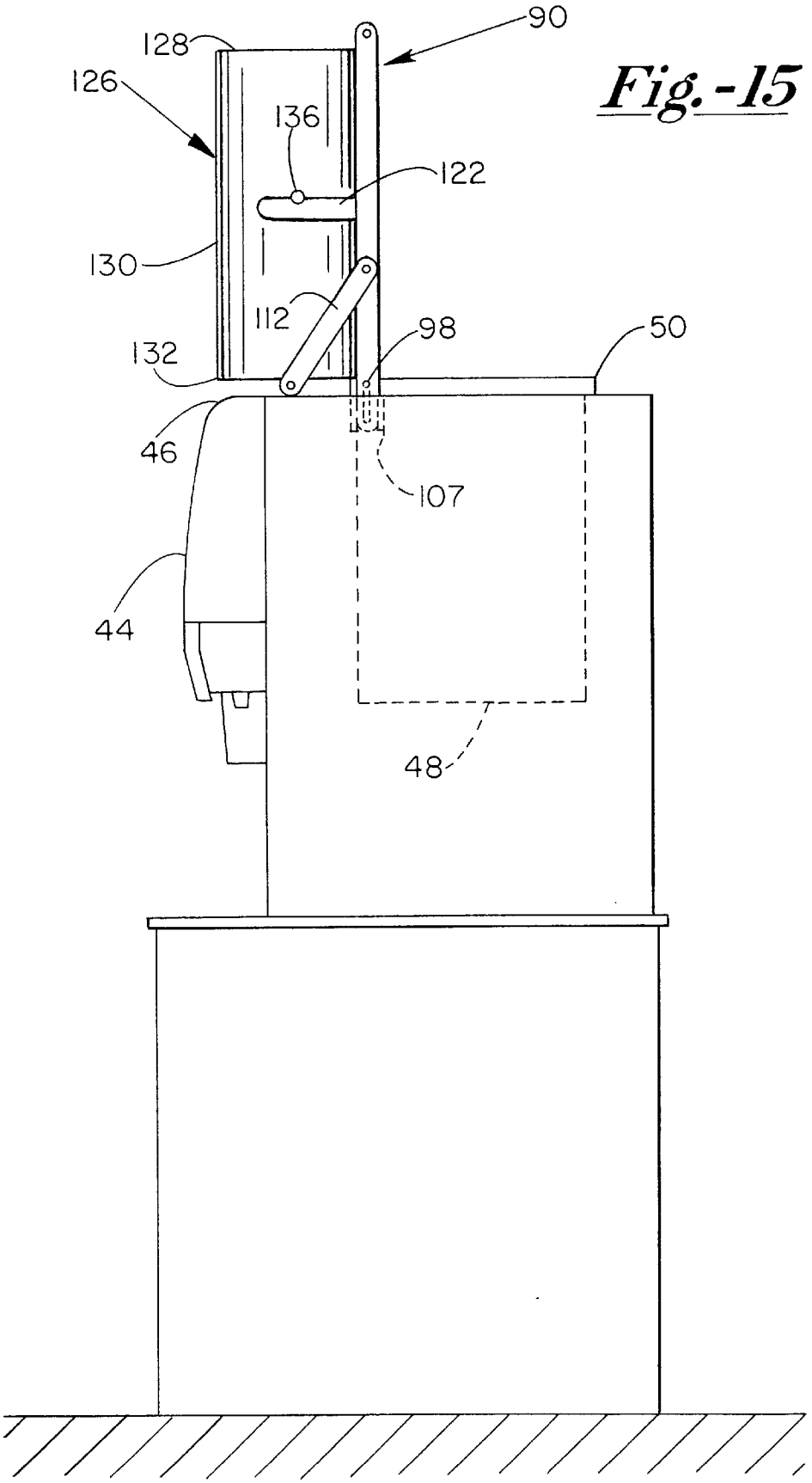
FIG. 15 shows a further side plan view of the fourth embodiment of the chute cover herein secured to a beverage dispenser in a bucket lifted position.

To fill ice bin 48, the lift gate 90 is positioned as seen in FIG. 14 and rods 136 of bucket 126 are placed in the notches 124 so that pivot arms 122 and support rod 120 support the weight of the ice bucket. The bucket is then moved to a position above dispenser 40 as seen in FIG. 15 by lifting the gate 90 by rod 108, pivoting arm 92 and pivoting middle arms 108 into alignment with arms 92 in a generally vertical orientation. Pivoting arm 92 in this manner causes ends 94 of arm 92 to enter slots 106 in top wall 42. Ends 94 contact stop wall 107 when arms 92 are vertical, thereby maintaining arms 92 in this position. Bucket 126 is then pivoted about rods 136 to clump ice into bin 48 as seen in FIG. 16. The lift gate 90 is then returned to its starting position and bucket 126 is removed.

Figure 17:
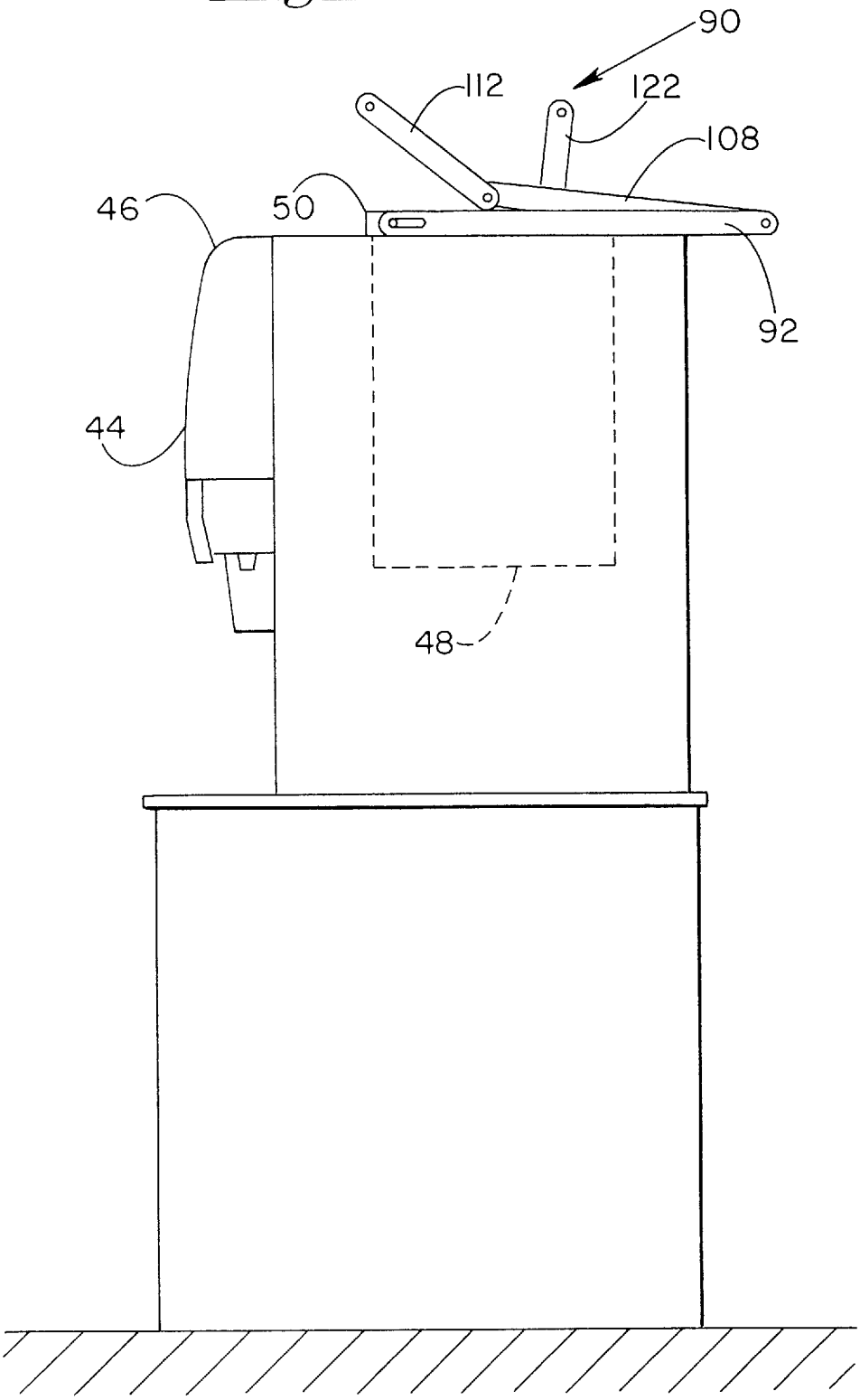
FIG. 17 shows a side plan view of the chute cover of FIGS. 14–16 in a closed position.

To store lift gate 90 when not in use, it is raised to the position shown in FIG. 15 with ends 94 in contact with stop 107. Gate 90 is then lifted to slide rod 98 from end 102 to end 104 of elongated opening 100. This action removes first ends 94 of arms 92 from slots 106 and allows arms 92 to travel past the vertical and to fold down on top of dispenser 40 as shown in FIG. 17.

What is claimed is:

1. A mechanism for directing ice into an ice retaining area of an ice dispenser, comprising:

a chute cover pivotally secured to a top surface of the dispenser, the chute cover moveable between a closed position and an open ice loading position, wherein in the closed position the chute cover encloses an opening in the dispenser top surface, the opening for providing access into the ice retaining area, and the chute cover having an ice guiding surface having a lip end on one end thereof and a back edge on the opposite end thereof, and when the chute cover is in the open position the lip end extending outward of a perimeter of the dispenser and the back edge extending along and directly adjacent a perimeter portion of the opening in the dispenser top surface so that ice placed on the ice guiding surface flows there along under the force of gravity to the back edge and into the ice retaining bin.

2. The mechanism as defined in claim 1, and further including an ice bucket having a portion extending therefrom adjacent a top end thereof for cooperatively mating with a receiving recess structure formed in the lip end of the chute so that the bucket can be retained thereby during pouring of ice from the bucket onto the ice guiding surface.

3. The mechanism as defined in claim 1, and the chute cover ice guiding surface including a pair of upright walls extending therefrom along opposite sides thereof between the front lip and the back edge.

4. The mechanism as defined in claim 1, and the chute cover having a handle for facilitating opening and closing thereof.

5. The mechanism as defined in claim 3, and further including an ice bucket having a portion extending therefrom adjacent a top end thereof for cooperatively mating with a receiving recess structure formed in the lip end of the chute so that the bucket can be retained thereby during pouring of ice from the bucket onto the ice guiding surface.

6. The mechanism as defined in claim 5, and the chute cover having a handle for facilitating opening and closing thereof.

* * * * *